United States Patent [19]

Oesterheld et al.

[11] Patent Number: 4,596,433

[45] Date of Patent: Jun. 24, 1986

[54] LAMPHOLDER HAVING INTERNAL COOLING PASSAGES

[75] Inventors: Klaus Oesterheld, Woodside; Michael Franovic, Forest Hills; Carlos Martinez, Brooklyn, all of N.Y.

[73] Assignee: North American Philips Corporation, New York, N.Y.

[21] Appl. No.: 761,292

[22] Filed: Jul. 29, 1985

Related U.S. Application Data

[63] Continuation of Ser. No. 681,717, Dec. 13, 1984, abandoned, which is a continuation of Ser. No. 454,910, Dec. 30, 1982, abandoned.

[51] Int. Cl.[4] ..... H01R 13/533

[52] U.S. Cl. ..... 339/112 R; 339/50 R

[58] Field of Search ..... 339/112 R, 50 R–57

[56] References Cited

U.S. PATENT DOCUMENTS 2,099,610 11/1937 Ledder ..... 339/50 R

FOREIGN PATENT DOCUMENTS 2251505 5/1973 Fed. Rep. of Germany .... 339/50 R 1402895 5/1965 France ..... 339/112 R

*Primary Examiner*—Eugene F. Desmond

*Attorney, Agent, or Firm*—Joseph P. Abate

[57] ABSTRACT

A holder for a discharge lamp having a bi-pin base includes a housing with two pairs of opposed walls connected to form a lamp base receiving recess therebetween, a resilient clip and an opposed pair of electrical conductors. The clip and the conductor pair are disposed in the housing for gripping the lamp base and for electrically engaging the lamp pins, respectively, of a lamp received into the holder.

The housing further includes four internal cooling passages partly formed by two directly facing and opposed rib pairs provided on the respective housing walls. The passages open to the ambient atmosphere. The resilient clip has good thermally conductive properties.

5 Claims, 20 Drawing Figures

LAMPHOLDER HAVING INTERNAL COOLING PASSAGES

This is a continuation of application Ser. No. 681,717 filed Dec. 13, 1984, which is a continuation of application Ser. No. 454,910 filed Dec. 30, 1982 both now abandoned.

BACKGROUND OF THE INVENTION

1. Field of the Invention

The present invention relates to holders for discharge lamps and particularly to such holders for fluorescent lamps having heat emissive electrical components contained within a portion of a bi-pin lamp base which is inserted into the holder for normal lamp operation.

Public and industry concern regarding energy conservation has led to the development of energy efficient discharge lamps such as the PL* brand of bi-pin fluorescent lamps sold by North American Philips Lighting Corporation. These lamps have a design which includes only one base and a generally U- shaped tubular glass envelope whose two parallel tubular portions are both mounted, at one end, on the base. Typically, the base is a unitary part formed of a suitable plastic. At the end opposite the base end, the tubular portions are welded together to provide fluid communication between them. Typically, the lamp includes a pair of filaments disposed within the two gas-filled tubular portions which also contain the fluorescent material. The lamp base is generally T-shaped and includes an elongate hollow trunk portion formed with an opposed pair of upper branch portions extending from the trunk. Metal wiring electrically connects the filament pair to electrical components disposed within the trunk cavity and to a respective pair of parallel opposed contact pins provided on and extending from the branches. The cavity-disposed components typically include part of a pre-heat and ballast circuit. Such components are in close proximity to each other and also to the lamp filaments. The lamp pins allow the electrical connection of such components to other components external of the lamp. These external conponents include the remainder of the ballast circuit and the power source.

2. Description of the Prior Art

For normal lamp operation, the trunk of the lamp base is received into a holder including a plastic housing having a lamp base receiving recess formed by the inside surfaces of two pairs of opposed housing walls and a floor. The contact pins of a received lamp are electrically engaged by a respective pair of opposed conductors suitably disposed within the holder. The holder disposed conductors are electrically connected by wires to the remainder of the ballast circuit external of the holder. More importantly, the housing walls and floor inside surfaces are all interconnected such that they each have close dimensional tolerances with the received lamp trunk. Further, the known holder has no effective fluid communication between the trunk-receiving recess and the ambient atmosphere outside of the holder. These known lamp holders, therefore, have not proven entirely satisfactory, because of overheating.

During operation, the power dissipation within the lamp contained circuit components causes the components disposed within the lamp base cavity to emit heat. This heat emission is increased by the cavity-disposed components' close proximity to the hot operating lamp filaments. This heat is transferred to the lamp base whose temperature, therefore, rises.

However, because of the close dimensional tolerances between the heated lamp base and the housing walls/floor and also because of the ineffective heat dissipation to the ambient atmosphere (the plastic housing is a relatively poor heat conductor), the known holders cause the component-emitted heat to be substantially retained within the lamp base and the immediately adjacent spaces between the base and the housing. Such heat retention is energy inefficient for lamp operation and may adversely affect overall lamp and/or holder life.

SUMMARY OF THE INVENTION

The principal object of the present invention, therefore, is to provide an improved lamp holder which is novel and simple in construction and permits a more energy efficient operation of a discharge lamp.

A further object of this invention is to provide a novel and improved fluorescent lamp holder which has means for effectively dissipating heat from the lamp base and adjacent spaces to the ambient atmosphere during normal lamp operation.

In accordance with the invention, the lamp holder includes a unitary housing defining a lamp base insertion axis and having two opposed side walls connected to opposed end walls to form a lamp base receiving recess therebetween. The housing walls are all parallel to the axis.

According to the invention, the housing further includes an internal cooling passage defined by at least one wall of the housing and extending generally in a direction parallel to the insertion axis. At least one end of the cooling passage must open to the ambient atmosphere. A cooling passage is realized effectively if two opposed housing walls are spaced by a distance substantially greater than the distance between a pair of opposed lamp base walls.

Preferably, the cooling passage is formed by a portion of an end wall, an adjoining portion of a side wall, and a rib adjacently spaced from the side wall portion and extending continuously along and inwardly from the housing end wall into the recess. The depth of the housing is desirably greater than the distance by which the lamp base trunk is pushed in so that a bottom space is defined between the housing bottom portion and the bottom of the trunk. The space then communicates with the ambient atmosphere by means of the passage.

Advantageously, the bottom portion of the housing has one or more vent holes arranged such that the bottom space also communicates with the ambient atmosphere by means of the holes.

In a preferred embodiment combining the features heretofore discussed, two directly facing pairs of ribs are provided on and integral with the opposed housing end walls. Each rib pair extends continuously along and inwardly from a respective housing end wall into the recess. Further, each rib pair has its respective ribs mutually separated by a distance considerably less than the distance between the inside surfaces of the opposed side walls. Accordingly, two opposed pairs of internal cooling passages are formed by the housing. Each rib pair also partly defines a clip retaining space for accommodating part of a single U-shaped resilient clip, preferably with good heat conducting properties, disposed and secured within the clip retaining spaces. The clip firmly grips and retains a lamp base trunk received within the housing recess and conducts heat away from the trunk during normal lamp operation.

Thus, a lamp holder according to the present invention utilizes convective and/or conductive principles to dissipate undesirable heat effectively from the operating lamp base and its surrounding spaces to the ambient atmosphere and overcomes the drawbacks of the prior art.

BRIEF DESCRIPTION OF THE DRAWING

The invention will now be described more clearly in conjunction with the accompanying drawing, in which.

DETAILED DESCRIPTION OF THE PREFERRED EMBODIMENTS

Figure 1A:
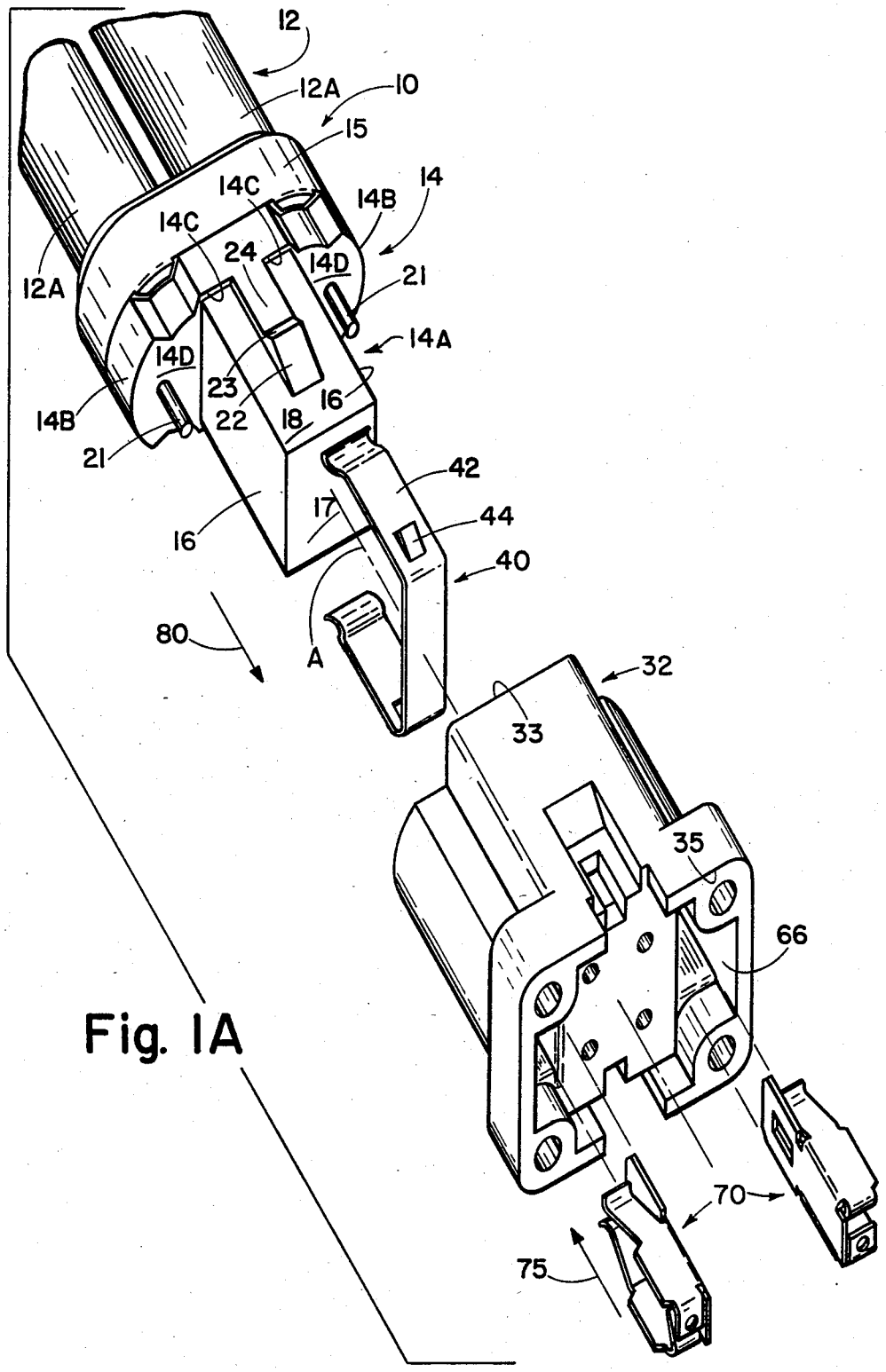
FIG. 1A is an exploded perspective view of a preferred lamp holder according to the invention and an energy efficient fluorescent lamp both aligned along a central insertion axis A.

Referring now to the figures and FIG. 1A in particular, there is shown a PL* energy efficient fluorescent lamp 10 aligned along an insertion axis A defined by a housing 32 of a lamp holder 30 constructed according to the present invention. The lamp 10 includes a gas-filled generally U-shaped tubular glass envelope 12 having a pair of parallel tubular glass portions 12A welded together at one end by a weld 13 (FIG. 1C). The envelope 12 contains the fluorescent material. At the end opposite the weld end, the envelope 12 is mounted on a generally T-shaped unitary base 14 formed of a heat resistant insulating material such as a suitable plastic. Base 14 is secured to envelope 12 by means of a metal cap 15 as shown in FIGS. 1A–1D. The base 14 comprises an elongate hollow trunk portion 14A provided, at an end nearest the envelope 12, with an opposed pair of hollow upper branch portions 14B extending from and integral with the trunk 14A. The portions 14B are identical and include stops or abutments 14C which will cooperate with the housing 32 in a manner which will be clear hereinafter. An opposed parallel pair of contact pins 21 is provided in the portions 14B and extends from the portion surfaces 14D in a direction longitudinal of the trunk 14A.

The trunk 14A includes a first pair of opposed side walls 16 fixed to a second pair of opposed side walls 18 and, at the end opposite the branch portion end, a bottom wall 17 fixed to both pairs of opposed side walls 16, 18. The trunk 14A extends from the bottom 17 to the cap 15. The trunk walls 16, 18 have internal surfaces (not shown) forming a cavity therebetween and, thus, the hollow of the trunk 14A. The internal surface (not shown) of the wall 17 defines the bottom of the cavity. The trunk cavity communicates with respective cavities formed by the internal surfaces of the branch portions 14B to permit electrical connections between the pins 21 and the components disposed within the trunk cavity.

The cavity-disposed heat emissive electrical components (not shown) are connected by metal wiring to a pair of filaments (not shown) disposed, respectively, within the pair of tubular portions 12A. Each filament is electrically connected to a respective pin 21 also by metal wiring (not shown). Thus, the trunk confined electrical components, together with the filaments, metal wiring and pins 21, may comprise part of a preheat and ballast circuit.

As clearly shown in the figures, the external (non-cavity forming) surfaces of the opposed side walls 16 lie in parallel planes which are perpendicular to respective planes containing the external surfaces of the opposed walls 18. These wall containing planes are thus all parallel to the insertion axis A (FIG. 1A). The external surface of the bottom 17 lies in a plane perpendicular to the planes containing the walls 16, 18 and, thus, is perpendicular to the axis A.

Both of the upper branch external surfaces 14D from which the pins 21 extend also lie in a single plane which is perpendicular to the axis A. Thus, the surfaces 14D are perpendicular to the external surfaces of the side walls 16, 18 but parallel to external surface of the bottom wall 17. Each pin 21 provides electrical contact between a respective filament electrically connected thereto and a respective contact strip 70 suitably disposed within the housing 32; See FIG. 2.

Figure 1B:
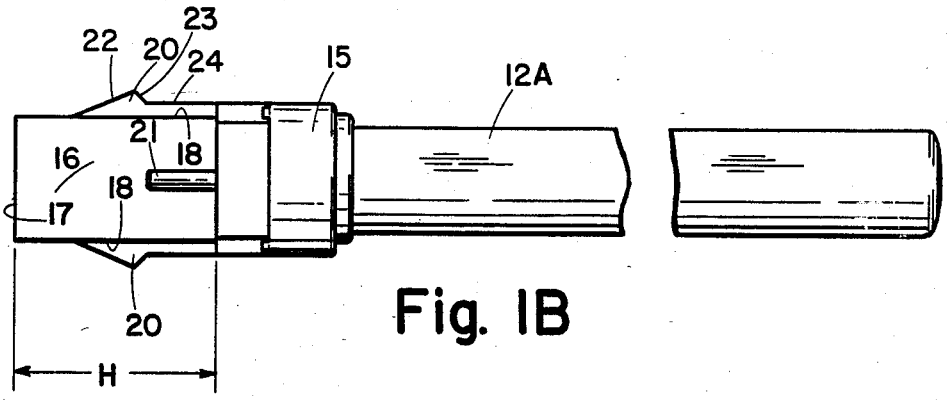
FIGS. 1B–1D are first side, second side, and bottom views, respectively, of the lamp of FIG. 1A.
Figure 1C:
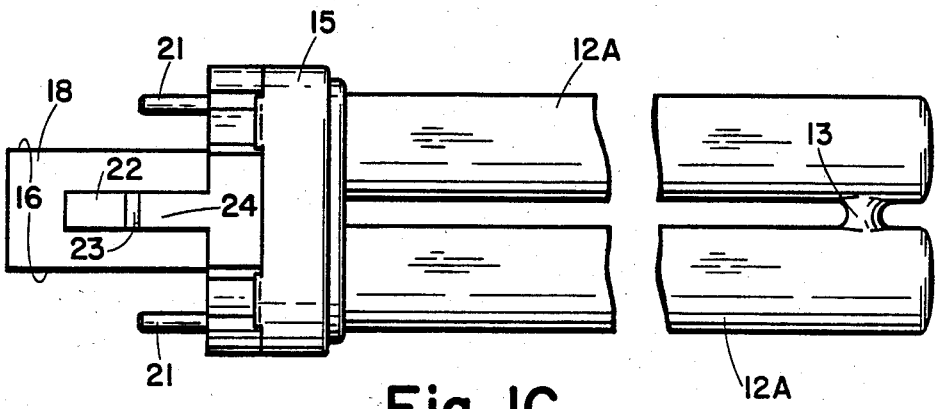
Figure 1D:
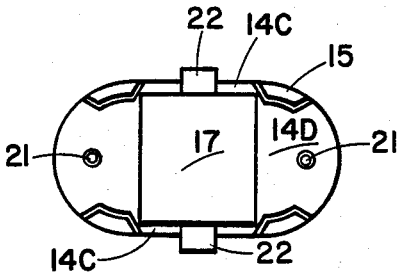
Figure 2:
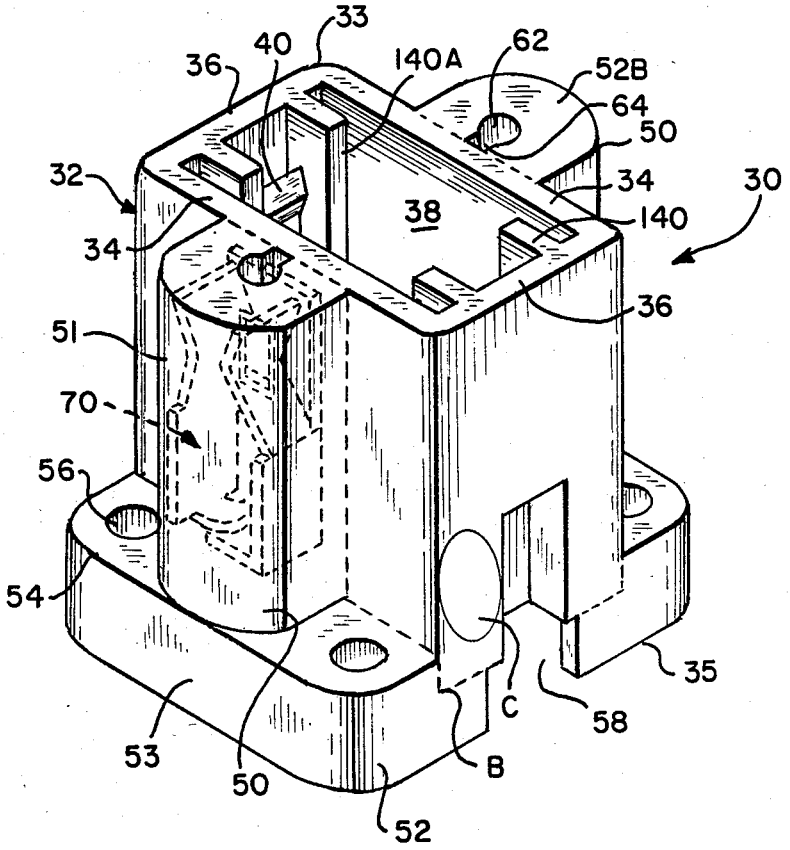
FIG. 2 is an enlarged perspective view of the holder of FIG. 1A.
Figure 3A:
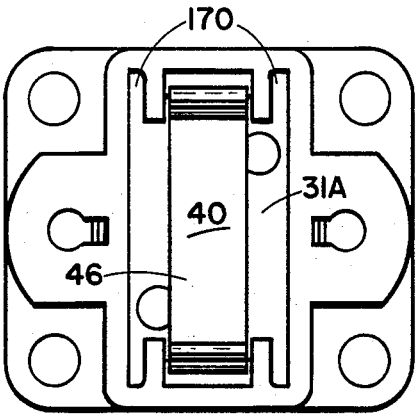
FIGS. 3A and 3B are top plan and bottom plan views, respectively, of the holder of FIG. 1A.

As clearly shown in FIGS. 1A and 1B, each opposed lamp wall 18 has an identical protuberance 20 projecting therefrom and connected to the branch portions 14B. A protuberance 20 includes external surfaces 22, 23, 24 for engagement with a resilient retaining clip 40 (FIG. 8A) securely disposed within the housing 32 (FIG. 3A). For this purpose, the surfaces 22, 23, 24 define respective inclined planes which make, for example, oblique angles with each other and with a respective wall 18 as shown in FIG. 1B. A clip 40 will grip and retain protuberances 20 and, thus, also a trunk 14A received within a holder recess 38 (FIG. 2).

All of the lamp base external surfaces, particularly, of the walls 16, 17, 18, protuberances 20, and branch surfaces 14D are smooth to facilitate a lamp's insertion into, seating on, and removal from the holder 30.

Turning now to a consideration of the lamp holder 30 according to the invention, attention is directed to FIG. 1A and FIGS. 2–9 which illustrate the details of a preferred embodiment therefor. The instant holder was designed for the economical mounting and energy efficient operation of any bi-pin discharge lamp having heat emissive electrical components confined by a lamp base portion received within the holder.

For example, ballast circuit components using inductance, capacitance or resistance, either singly or in combination, can limit the lamp current for discharge lamps to the required value for proper operation, and also, where necessary, provide the required starting voltage and current. Any or all of these components could be contained by a lamp base portion inserted into a holder for normal lamp operation.

As shown in the embodiment of FIG. 1A, holder 30 comprises only four basic parts—the housing 32, the lamp base retaining clip 40, and an opposed pair of electrical conductors 70.

Conductors 70 may be, for example, elongate contact strips of the screwless or pressure locking type. However, screw type conductors are also within the scope of the invention. As shown in FIGS. 1A, 2, 3A and 3B, the clip 40 and the strips 70 are suitably disposed within the housing 32 by first pushing them in opposite directions shown by the arrows 80, 75. Resilient clip 40 is dimensioned, detachably secured in the housing, and arranged such that the clip will retain a trunk portion 14A pushed past an insertion end 33 of the holder 30 an adequate distance to be received within the recess 38. Each strip 70 is dimensioned, detachably disposed in the housing, and arranged such that the strip, at a pin end thereof, can electrically engage a pin 21 which has passed a sufficient distance through an opening 62, while, at an end opposite the pin end, it can electrically connect to a bared metal wire (not shown). The wire is electrically coupled to the remaining ballast circuitry and the power source, both not shown.

The housing 32, clip 40 and strips 70, preferably, are separate unitary members manufactured by techniques well-known in the art. Such techniques, therefore, will not be described.

HOUSING

As shown in FIG. 2, the unitary housing 32 includes two opposed side walls 34 perpendicularly connected to opposed end walls 36, and a bottom portion 31 (FIGS. 3A–3B) perpendicularly connected to the opposed side and end walls 34, 36. An opposed pair of identical housing structures 50 is provided on and integral with the respective side walls 34. The structures 50 are shown diagrammatically separated from the remainder of the holder 30 by the dotted curve B in FIG. 2. Structures 50 support the holder 30 and contain respective strips 70 suitably disposed along the outside surfaces 34B of respective side walls 34. The housing 32 has a substantially uniform thickness and may be formed from any suitable heat resistant insulating material. For example, a polyester plastic such as Valox brand sold by General Electric may be used.

Figure 4:
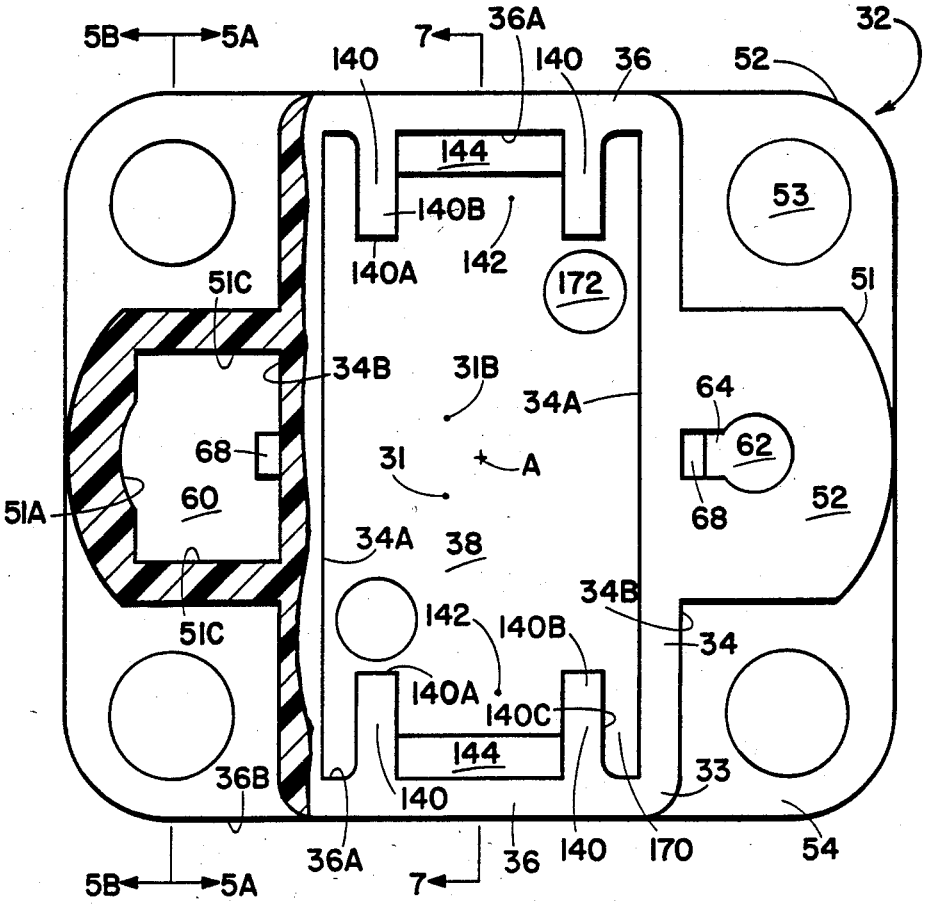
FIG. 4 is a top plan view, partially cut away, on an enlarged scale, of the unitary housing for the holder shown in FIG. 1A.
Figure 5A:
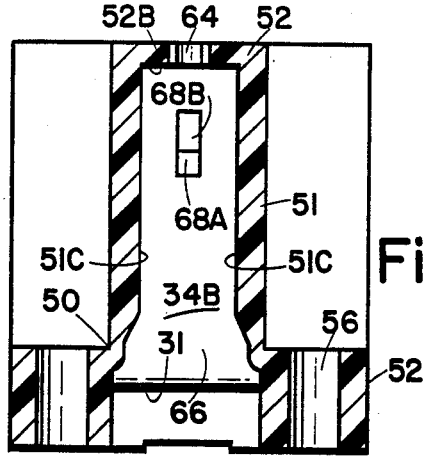
FIGS. 5A and 5B are cross-sectional views taken through the lines, 5A—5A and 5B—5B, respectively, of the housing shown in FIG. 4.
Figure 5B:
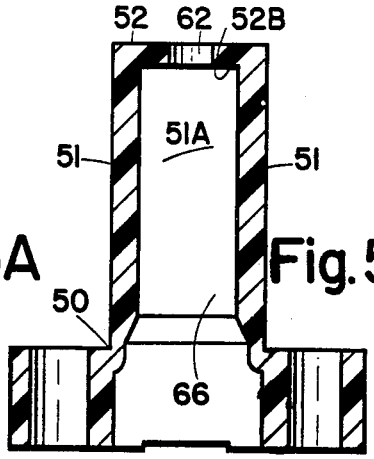

As also shown in the enlarged plan view of FIG. 4, the housing walls 34, 36 each have planar inside surfaces 34A, 36A dimensioned to form the recess 38 for accommodating a trunk 14B and thus to define the lamp base insertion axis A, and planar outside surfaces 34B, 36B parallel to the inside surfaces. The inside 34A, 36A and outside surfaces 34B, 36B of the housing walls, therefore, lie in respective planes parallel to the insertion axis A while the bottom portion 31 has inside and outside surfaces 31A, 31B lying in respective mutually parallel planes which are perpendicular to the axis A. The axis A intersects the center of both the housing bottom portion 31 and the lamp bottom wall 17 as shown in FIG. 1A.

Specifically, in order to accommodate a trunk 14A within the housing 32, the inside surfaces 34A of the housing side walls 34 are spaced by a distance (e.g. 17/32") slightly greater than the distance (e.g. 16/32") between the external surfaces of the opposed lamp base walls 16 (FIG. 1C). In this embodiment, the inside surfaces 36A of the housing end walls 36 are spaced by a distance (e.g. 31/32") substantially greater than the distance (e.g. 26/32") between the outermost surfaces of the lamp base protuberances 20. This greater distance permits the housing 32 to accommodate the retaining clip 40 dimensioned for engaging with the protuberances 20 and retaining the trunk 14A within the recess 38. This greater distance further permits the formation of the internal cooling passages 170 explained hereinafter.

Preferably, the recess 38 has a depth measured from the holder insertion end 33 to the inside surface 31A of the bottom portion 31 (hereinafter defined as the Insertion Depth [INS D], FIG. 7) greater than the maximum distance through which the lamp base 14 can be pushed into the recess 38. It is evident from FIGS. 1A and 1B that INS D should be greater than the Height (H) of the trunk portion 14A of the lamp base 14. For example, when H was 28/32 inches INS D was one inch.

Figure 8A:
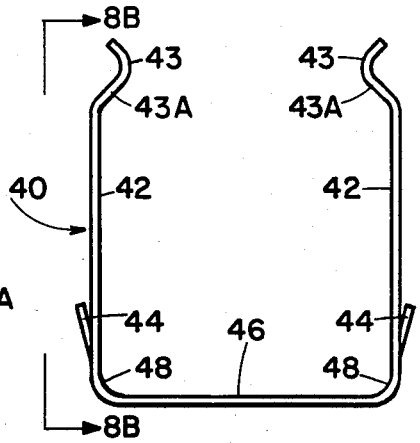
FIGS. 8A–8C are various perspective views of a lamp retaining clip used in the holder embodiment of FIG. 1A.

As shown in FIG. 4, the housing 32 further includes two pairs of directly facing identical ribs 140 provided on and integral with the opposed end wall inside surfaces 36A. Each rib pair extends an equal distance from its respective end wall 36 into the recess 38. Each rib pair also extends continuously along the wall 36 from the bottom portion 31 to the insertion end 33 in a direction parallel to the insertion axis A. The directly facing surfaces 140A, therefore, are parallel to the walls 36 and to the axis A. The rib pairs are spaced by a distance (e.g. 22/32") slightly greater than the distance (e.g. 19/32") between the external surfaces of opposed lamp base walls 18. Further, the space between the ribs 140 provided on a respective wall 36 is sufficient to accomodate a lamp base gripping arm 42 of a resilient clip 40 (FIG. 8A). Each rib pair will also block movement of an arm 42 in a direction transverse to the insertion axis A. Thus, each rib pair partly defines a space 142 for retaining a resilient clip 40 inserted between the end walls 36.

To define further the clip retaining space 142, a clip retaining portion 144 is provided on and integral with the inside surface 36A of each end wall 36. Portions 144 extend from each wall 36 into the recess 38 and continuously between respective ribs 140 as shown in FIG. 4 and more clearly in the cross-sectional view of FIG. 7. The portions 144 have tab receiving slots 152 formed partially by tab engaging notches 154. The slots 152 are each adapted to receive and retain a flexible tab 44 of a resilient clip 40 shown in FIGS. 8A and 8B. The portions 144 are mutually spaced and dimensioned to retain a resilient generally U-shaped clip 40 detachably therebetween and, therefore, to prevent undesired movement of the retained clip in a direction opposite to the insertion direction indicated by the arrow 80 in FIG. 1A.

Figure 3B:
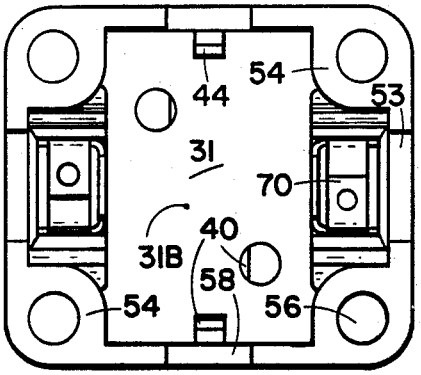

Thus, a space 142 for retaining part of the clip 40 is located generally at each end wall and is defined by respective ribs 140 and a respective portion 144. A suitably retained clip 40 as shown in FIG. 3B seats on the inside surface 31A of the bottom portion 31 and extends continuously between the mutually parallel surfaces 144A of the portions 144. Preferably, ribs 140, portions 144, structures 50 and the remainder of the housing 32 are formed as a unitary member.

RESILIENT CLIP

Figure 8B:
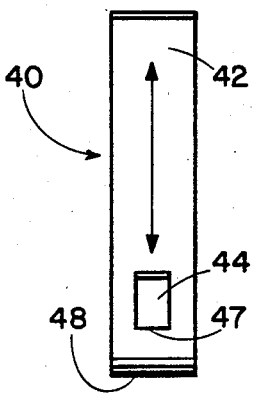
Figure 8C:
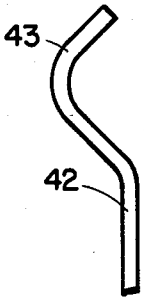

Directing attention now to the unitary clip 40, FIGS. 8A–8C show a preferred embodiment. The unitary clip 40 may be stamped and formed from any suitable resilient material such as a spring-tempered planar metal strip (e.g. full hard stainless steel) having a uniform thickness and a grain direction as indicated in FIG. 8B. Preferably, the clip 40 is formed of a material having not only the required resiliency but also good thermally conductive properties such as a spring-tempered copper alloy. Beryllium copper and zinc copper based alloys, for example, may be used. Forming two "good way" bends 48 in the metal strip results in a lamp base retaining clip 40 which includes an opposed pair of resilient gripping arms 42 perpendicularly associated at one end with an arm support transverse member 46. As is understood by those skilled in this art, good way refers to a bend about an axis generally perpendicular to the grain direction of the metal. Thus, the arms 42 are normally resiliently biased toward each other. An opposed pair of curved terminations 43 is formed respectively on the opposed pair of arms 42 at the clip end opposite the support member end. The pair of arms 42 further includes a respective pair of flexible tabs 44 produced by good way bends 47 (FIG. 8B). The tabs 44 extend from the arms 42 at oblique angles in a direction away from one another. The tabs 44 are normally resiliently biased away from each other. Tabs 44, arms 42 and terminations 43 may be produced by known progressive die techniques.

The distance between bends 48 along the member 46 substantially corresponds to the distance between the outermost surfaces of the lamp base protuberances 20 shown in FIG. 1B. The distance between each bend 48 and the base engaging part 43A of a respective termination 43 generally corresponds to the distance, along lamp wall 18, between the bottom wall 17 and the interface of the surfaces 23, 24 of a lamp 10. The clip 40 must be dimensioned such that the distances between bends 48 along member 46 and between a bend 48 and a respective curved termination 43 along an arm 42 allow the terminations 43 to engage with and grip the lamp base protuberances 20 inserted between them.

A clip 40 is positioned member 46 first in the housing 32 by suitably arranging the arms 42 between the ribs of each rib pair and then pushing member 46 along the axis A in the direction of arrow 80 into the spaces 142 until member 46 rests on bottom portion 31. During this positioning, tabs 44 are flexed toward each other by housing portions 144 until the tabs are accepted into the slots 152.

Thus, the clip member 46 is seated on bottom portion 31 between portions 144 while tabs 44 resiliently engage with respective notches 154 to retain the clip 40 within the housing 32. Ribs 140 block undesired movement of the arms 42 in a direction transverse to the axis A.

INTERNAL COOLING PASSAGES

The internal cooling passages essential to the present invention are shown in FIG. 3B and still more clearly in the enlarged view of FIG. 4. Each rib 140 extends into the recess 38 from its respective end wall 36 and is laterally spaced from a portion of its adjacent side wall 34.

Thus, a cooling passage 170 is formed by the surface 140C of a rib 140, the inside surface 34A of a portion of its immediately adjacent side wall 34 and a surface 36A of a portion of a respective end wall 36 which spaces the rib 140 laterally from the side wall 34. The passage 170 opens to the ambient atmosphere at least at the lamp insertion end 33. For example, when each rib extended into the recess 5/32 inches, each rib was spaced from its adjacent side wall by 2/32 inches to form four cooling passages.

Desirably, bottom portion 31 has a plurality (e.g. two) of vent holes 172 therethrough. The holes 172 are arranged such that a bottom space 160 (FIG. 9) formed under an operating lamp 10 can communicate with the ambient atmosphere not only by means of the passage but also by means of the vent holes 172.

CONTACT STRIP

To provide electrical contact between the pair of lamp pins 21 and a pair of wires (not shown) connected to the electrical circuitry (not shown) external of the holder 30, a respective pair of resilient contact strips 70 is provided on and suitably disposed along the outside surfaces 34B of the housing side walls 34. One strip 70 is shown diagrammatically in FIG. 2. Identical elongate strips 70 are of the pressure locking or screwless variety and extend in a direction longitudinal of the insertion axis A.

A strip 70 is a unitary member stamped from a planar metal strip of uniform thickness suitably deformed by, for example, well-known progressive die techniques. The metal strip must have not only good electrically conductive properties but also good resiliency. A spring-tempered copper alloy is appropriate.

Figure 6A:
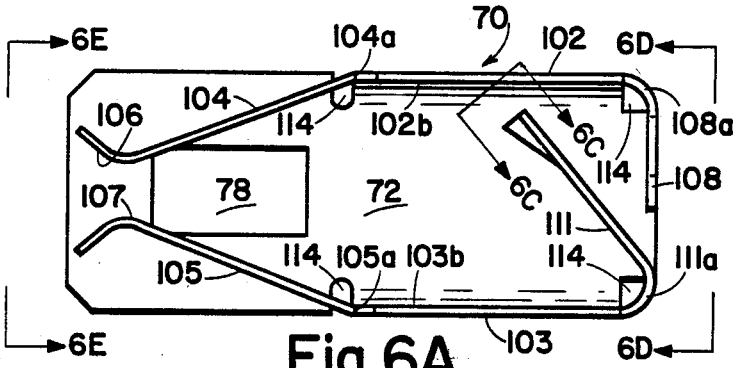
FIGS. 6A–6E are various perspective views of an elongate contact strip used in the holder embodiment of FIG. 1A.
Figure 6B:
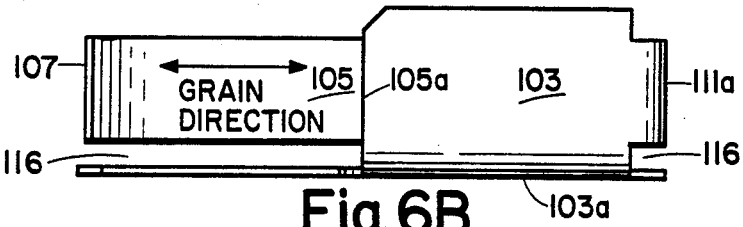
Figure 6C:
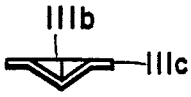
Figure 6D:
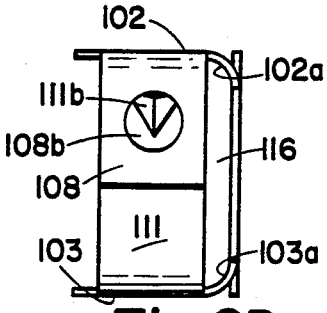
Figure 6E:
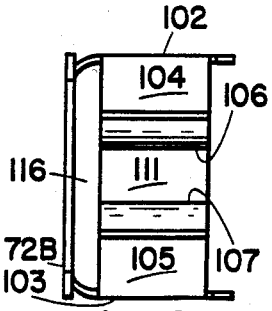
Figure 7:
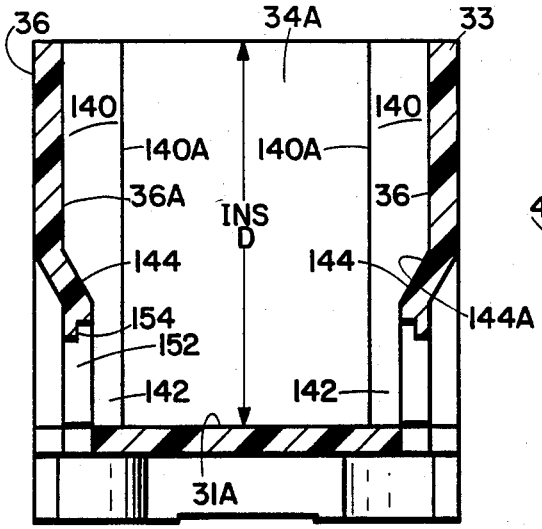
FIG. 7 is a cross-sectional view taken through the line 7—7 of FIG. 4.

As shown in FIGS. 6A–6E, unitary strip 70 comprises an elongate support member 72 including a portion having a rectangular aperture 78. Two "bad way" bends 102*a*, 103*a* (FIG. 6D) produce, respectively, opposed strip sections 102, 103 oriented generally transverse to member 72 as clearly shown in FIGS. 6A, 6B and 6D. As understood by those skilled in this art, bad way refers to a bend about an axis generally parallel to the grain direction of the metal. At one end, sections 102, 103 include opposed and generally converging gripping fingers 104, 105 produced by respective first and second "good way" bends 104*a*, 105*a* and spaced from member 72 by a space 116 (FIG. 6B). The fingers 104, 105 have respectively formed tips 106, 107.

The gripping fingers 104, 105, converge to a first oblique angle and are normally resiliently biased toward each other to provide a force for gripping a lamp pin 21 inserted sufficiently between the tips 106, 107. Thus, the tips 106, 107 are spaced by a distance less than the diameter of a pin 21. See FIG. 6E and FIG. 1D.

At the end opposite the finger end, the section 103 includes a pressure locking strip 111 formed by a third good way bend 111*a* (FIG. 6A). The locking strip 111 extends from the wall 103*b* at a second oblique angle in a direction toward the opposed section 102, in this case, toward wall 102*b*. Locking strip 111 is normally resiliently biased toward the wall 102*b* and is extended a distance sufficient to wedge a bared wire conductor (not shown) against the wall 102*b* when the wire is thrust suffiently between the resilient strip 111 and the section 102 to cause strip 111 to flex about the pivot of bend 111*a*. In order to increase both the effective wedging force and the electrical contact area between the wire and the contact strip 70, the locking strip 111 has a shallow tapered groove 111*b* (FIG. 6C) whose depth gradually increases toward the strip end 111*c* opposite the bend 111*a*.

At the end opposite the finger end, section 102 includes a wire guide strip 108 formed by a fourth good way bend 108*a* (FIG. 6A). The strip 108 extends from wall 102*b* at generally a perpendicular angle toward opposed section 103. Strip 108 has an aperture 108*b*.

The aperture 108*b* is aligned with the groove 111*b* and guides a bared end of a wire conductor thrust through aperture 108*b* sufficiently into engagement with the groove 111*b*.

The fingers 104, 105, strip 111 and section 108 are all spaced the same distance 116 from the member 72. Also, in practice, producing bad way bends 102*a*, 103*a* is the final step in a strip's 70 manufacture which is aided by the notches 114.

When suitably disposed in the housing 32, each elongate strip member 72 has a planar surface 72B (FIGS. 2 and 6E) disposed flush against the outside surface 34B of a respective side wall 34 in a direction longitudinal of the axis A. A projection 68 (described below) provided on and integral with the housing wall surface 34B projects through the aperture 78 a distance sufficient to prevent movement of the strip 70 at least in the direction opposite to the arrow 75. The strips 70 are mutually spaced by a distance generally corresponding to the distance between the centers of the lamp pins 21. The strips 70 are arranged such that each electrically engages a respective pin 21 of a lamp 10 received into the recess 38. This arrangement will be further explained with reference to the structures 50.

In order to bias the elongate members 72 of each contact strip 70 against the outside 34B of a respective side wall 34 and to insulate the strips 70 for safety, unitary housing 32 may be formed with an opposed pair of identical elongate support structures 50 as shown in FIGS. 1A, 2, 4, 5A and 5B. Identical structures 50 each extend from the lamp insertion end 33 to the bottom end 35 of the housing in a direction longitudinal of the axis A.

A structure 50 comprises an elongate upper portion 51 formed with a lower portion 52 extending generally transverse of the portion 51. Upper portion 51 is formed, at one end, with a cap portion 52 having a pin admitting opening 62 and a contact strip unlocking slot 64. Opening 62 and slot 64, together, may be "key" shaped as shown.

Structure portion 51 includes opposed inside planar surfaces 51C perpendicularly connected to generally planar inside surface 51A to form a duct 60 shown in FIG. 4. Surface 51A is, therefore, disposed opposite the sidewall surface 34B. The duct 60 is dimensioned for receiving a contact strip 70 pushed sufficiently through a strip admitting opening 66 and for biasing an admitted strip against the outside surface 34B of a respective side wall in a direction generally perpendicular to the insertion axis A. The duct 60 also communicates with the opening 64 to admit and then to receive a lamp pin 21 into the duct 60. The pair of openings 62 is arranged to admit pins 21 of an inserted lamp base and, therefore, has centers spaced by a distance corresponding to the centers of pins 21 of a lamp 10.

Provided on and extending into the duct 60 from the respective side wall surface 34B is a strip retentive projection 68 integrally formed with wall 34. As shown in FIG. 2 and the cross-sectional view of FIG. 5A, projection 68 comprises an inclined planar surface 68A extending obliquely from the side wall surface 34B and terminating in a second planar surface 68B generally parallel to the surface 34B. The projection 68 extends into the duct 60 and cooperates with the surface 51A so that, when the strip is inserted sufficiently in the direction of the arrow 75 (FIG. 1A), the part of the strip support member 72 having the aperture 78 is biased to engage with the surface 68A, flex away from the surface 34B, slide up surface 68A and along surface 68B until the time when the aperture 78 envelops the projection 68. At this time, the strip part resiliently returns flush with surface 34B to retain the strip 70 within the duct 60. Further strip movement into the duct is stopped by cap 52. Thus, the fingertips 106, 107 are immediately adjacent the opening 62. Spaces 116 of strip 70 must be dimensioned to permit the strip part to flex and envelop the projection 68. Further, wall surfaces 51C are dimensioned to brace received strip walls 102, 103 so that a strip has a snug fit within the duct 60.

To insure that a lamp base 14 is properly seated on the holder 30, the surfaces 52B, housing wall pairs 34, 36 and rib pairs 140, at the insertion end 33, are smooth and lie generally in a single plane.

As shown in FIG. 2, a lower support portion 52 includes a pair of mounting lugs 54 coupled by connections 53. Lugs 54 may each have an aperture 56 therethrough for insertion of, for example, a screw for mounting the holder to any suitable surface.

The opposed pair of structures 50 also forms two wire exit openings 58. After a bared wire end has been thrust through strip aperture 108*b* a sufficient distance such that portion 111 flexes and wedges the wire within the strip 70, the remaining wire may exit the holder through the opening 58.

DESCRIPTION OF OPERATION

For normal lamp operation, the base 14 is inserted into the holder 30 (see FIG. 1A) by generally aligning pins 21 with respective openings 62 and then pushing the trunk 14A along the insertion axis in the direction of arrow 80 past the insertion end 33 into the recess 38.

As the trunk 14A is further pushed, the opposed rib surfaces 140*a* guide the opposed lamp walls 18 so that protuberance surfaces 22 engage with clip terminations 43 which, upon further pushing, cause resilient arms 42 to flex away from one another about housing portions 144 until the clip surfaces 43A resiliently grip lamp surfaces 23 to retain the lamp within the holder 30.

In this seated position of the lamp, upper branch portion external surfaces 14D lie generally flush against the planar surfaces, including surfaces 52B, at the insertion end 33 of the holder 30. Rib surfaces 140B (FIG. 4) contact lamp abutments 14C while each fingertip pair of a respective strip 70 grips and electrically engages a lamp pin 21 received between the fingertips. Specifically, as a pin 21 was pushed past fingertips 106, 107, respective arms 104, 105 flexed about bends 104*a*, 105*a* sufficiently to grip the pin 21.

Figure 9:
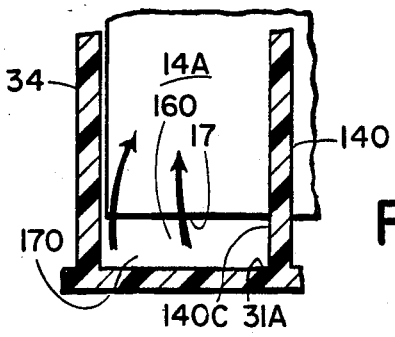
FIG. 9 is an enlarged view of an internal cooling passage taken through the circled area C of the holder end wall shown in FIG. 2.

The operation of the above described lamp holder will now be discussed with reference to FIG. 9. FIG. 9 is a view through a relevant portion of the circled end wall area C as shown in FIG. 2 but with a lamp base trunk 14A suitably received within the recess 38. A bottom space 160 is formed between the lamp bottom wall 17 and the housing bottom portion 31.

FIG. 9 shows one of the cooling passages 170 of the holder embodiment of FIG. 1 according to the invention. For purposes of this description, the holder-lamp combination is mounted in the upright position shown—i.e. oriented such that the weld end of the lamp is directly above the holder 30. An internal cooling passage 170, therefore, has a perimeter which lies generally in a plane transverse to the insertion axis. This perimeter is defined by the appropriate surfaces of a rib 140, side wall 34, end wall 36 and trunk portion 14A of a base 14 inserted into the holder.

During typical lamp operation, electrical components cause trunk 14A to emit or radiate heat which causes the fluid (e.g. air) having a positive coefficient of thermal expansion to have a reduced density causing the air to rise (arrows). Because the passages 170 open to the cooler ambient atmosphere at the lamp insertion end 33 (FIG. 4), the thermal energy is transferred out of the air. The air's density will then increase and the now heavier air will return to the spaces, e.g. space 160, adjacent the trunk 14A by known convective principles.

As shown in FIGS. 3A and 3B, the bottom space 160 also communicates with the ambient atmosphere by means of the vent holes 172 arranged in bottom 31 to aid convective fluid flow through the holder. Vent holes 172 also permit the utilization of forced convection (for example, by using a fan) to facilitate the flow of heated air from the holder to the external ambient atmosphere.

When the holder-lamp combination is mounted in the downright position—i.e. arranged such that the weld end of the lamp 10 is directly below the holder 30—the heated air within the passages 70 and the space 160 will pass through the vent holes 172 and transfer heat to the cooler ambient atmosphere. Particularly in this position, use of a resilient clip 40 having good heat conductive properties facilitates this heat transfer by efficiently conducting heat from the trunk portion 14A to the space 160. For the particular described embodiment, four cooling passages 170 each having the dimensions $5/32 \times 2/32 \times 32/32$ inches worked particularly well when the recess 38 measured $31/32 \times 17/32 \times 32/32$ inches.

While there has been shown and described what is at present considered a preferred embodiment of the improved lamp holder, it will be apparent to those skilled in the art that various changes and modifications may be made therein without departing from the spirit and scope of the invention as defined by the appended claims.

For example, the opposed housing side walls could be spaced by a distance considerably greater than a respectively opposed pair of lamp base walls so that opposed rib pairs may also be provided on the side walls to increase the number of cooling passages in the holder. Of course, any or all the housing walls may be substantially non-planar for cooperating with a discharge lamp having, for example, an oval or obround lamp base.

What is claimed is:

1. A holder for an energy efficient fluorescent lamp having a bi-pin base including a first pair of opposed side walls connected to a second pair of opposed side walls, and a bottom wall connected to both pairs of opposed side walls, the holder comprising:

a unitary housing defining a lamp base insertion axis and having two opposed side walls connected to opposed end walls to form a lamp base receiving recess therebetween, the housing walls being substantially parallel to the insertion axis, and a bottom portion connected to the housing side and end walls in a direction substantially perpendicular to the insertion axis, and a pair of opposed elongate contact strips, disposed on the housing side walls and extending in a direction longitudinal of the insertion axis, for electrically engaging a respective pair of lamp pins when a lamp is received into the holder, characterized in that the housing includes two directly facing and opposed pairs of ribs, each rib pair extending into the recess from and continuously along a respective end wall, each rib being laterally spaced from a respective portion of a side wall, whereby four internal cooling passages are defined by the ribs, the side wall portions and the end walls, that the rib pairs define opposed clip retaining spaces, and that a resilient generally U-shaped heat conductive clip is disposed within the opposed clip retaining spaces, for gripping a pair of opposed lamp base walls and retaining a lamp base inserted into the recess, whereby the clip conducts heat energy away from the lamp base during normal operation of the lamp.

2. A holder as claimed in claim 1, characterized in that the heat conductive clip is an alloy selected from the group consisting of copper beryllium and copper zinc based alloys.

3. A holder as claimed in claim 1, characterized in that the housing has an insertion depth greater than the distance by which the lamp base is pushed into the recess, whereby a bottom space is defined in the holder between the housing bottom portion and the lamp bottom wall, so that the cooling passages communicate with the space.

4. A holder as claimed in claim 3, wherein the cooling passages open to the ambient atmosphere at the lamp insertion end, whereby the bottom space under the lamp communicates with the ambient atmosphere by means of the passages.

5. A holder as claimed in claim 4, wherein the housing bottom portion has at least one vent hole arranged such that the bottom space also communicates with the ambient atmosphere by means of the vent hole.

* * * * *